US007867045B2

(12) United States Patent
McAlonis

(10) Patent No.: US 7,867,045 B2
(45) Date of Patent: Jan. 11, 2011

(54) ELECTRICAL CONNECTORS AND ASSEMBLIES HAVING SOCKET MEMBERS

(75) Inventor: Matthew Richard McAlonis, Elizabethtown, PA (US)

(73) Assignee: Tyco Electronics Corporation, Berwin, PA (US)

( * ) Notice: Subject to any disclaimer, the term of this patent is extended or adjusted under 35 U.S.C. 154(b) by 176 days.

(21) Appl. No.: 12/177,646

(22) Filed: Jul. 22, 2008

(65) Prior Publication Data

US 2010/0022142 A1 Jan. 28, 2010

(51) Int. Cl.
*H01R 9/24* (2006.01)

(52) U.S. Cl. ..... 439/891; 439/682; 439/825; 439/701

(58) Field of Classification Search ..... 439/701, 439/682, 79, 825, 691
See application file for complete search history.

(56) References Cited

U.S. PATENT DOCUMENTS 3,716,817 A * 2/1973 Wolfe et al. ..... 439/346
4,105,277 A * 8/1978 Jacobs ..... 439/682
4,170,393 A * 10/1979 Mocek et al. ..... 439/601
4,193,655 A * 3/1980 Herrmann, Jr. ..... 439/166
4,311,355 A * 1/1982 Plyler et al. ..... 439/274
4,944,686 A * 7/1990 Gertz ..... 439/175
5,051,108 A * 9/1991 Lincoln ..... 439/825
5,133,679 A 7/1992 Fusselman et al.
5,194,020 A 3/1993 Voltz
5,362,261 A 11/1994 Puerner
5,588,852 A 12/1996 Puerner
5,842,872 A * 12/1998 Hosler et al. ..... 439/63
6,116,931 A * 9/2000 McCleerey et al. ..... 439/173

OTHER PUBLICATIONS

Z-Pack TinMan High Speed, High Density Backplane Connector, www.tycoelectronics.com/zpacktinman, 40 pages, Jul. 2007.
Z-Pack TinMan, Connector System; www.tycoelectronics.com/zpacktinman, 37 pages, Mar. 18, 2008.
Ultra Miniature (LEPRA/CON) RF Connectors Product Line Information, www.tycoelectronics.com/zpacktinman, 3 pages, printed from website on May 23, 2008.
International Search Report, International Application No. PCT US2009/004252, International Filing Date Jul. 22, 2009.

* cited by examiner

*Primary Examiner*—Hien Vu

(57) ABSTRACT

An electrical connector is provided and includes a housing that has a mating face configured to engage a mating connector. The electrical connector also includes a plurality of conductors that extend through the housing and a plurality of socket members that project from the mating face. Each socket member is electrically coupled to one of the conductors and includes a shaft that is configured to be inserted into a cavity of the mating connector. The shaft forms a passage that is configured to receive an associated mating contact held within the cavity for establishing an electrical connection.

19 Claims, 6 Drawing Sheets

ELECTRICAL CONNECTORS AND ASSEMBLIES HAVING SOCKET MEMBERS

BACKGROUND OF THE INVENTION

The subject matter herein relates generally to electrical connectors and assemblies, and more particularly, to electrical connectors and assemblies that are configured to maintain an electrical connection while in extreme or inhospitable environments.

Electrical connectors provide communicative interfaces between electrical components where power and/or signals may be transmitted therethrough. For example, the electrical connectors may be used within telecommunication equipment, servers, and data storage or transport devices. Typically, electrical connectors are used in environments, such as in offices or homes, where the connectors are not subjected to constant shock, vibration, and/or extreme temperatures. However, in some applications, such as aerospace or military equipment, the electrical connector must be configured to withstand certain conditions and still effectively transmit power and/or data signals.

For example, in one conventional connector assembly, an electrical connector includes a mating face that is configured to engage another connector. The electrical connector includes a plurality of conductors that extend through the electrical connector and into a cavity near the mating face. Each conductor is coupled to or forms into a spring beam that projects into the cavity of the connector. Each cavity and spring beam is configured to electrically couple to a corresponding pin from the other connector when the pin is inserted. However, while the conventional connectors may be effective, for friendlier environments, such as in a home or office, the connectors have limited capabilities in maintaining, the electrical connection in environments that include extreme temperatures or in environments that include constant shock or vibrations.

Accordingly, there is a need for an electrical connector that, during the connector's normal course of usage, can withstand conditions harsher than typically experienced in a home or office environment. Furthermore, there is also a need for electrical connectors that offer alternative means for maintaining an electrical connection.

BRIEF DESCRIPTION OF THE INVENTION

In one embodiment, an electrical connector is provided and includes a housing that has a mating face configured to engage a mating connector. The electrical connector also includes a plurality of conductors that extend through the housing and a plurality of socket members that project from the mating face. Each socket member is electrically coupled to one of the conductors and includes a shaft that is configured to be inserted into a cavity of the mating connector. The shaft forms a passage that is configured to receive an associated mating contact held within the cavity for establishing an electrical connection.

Optionally, the shaft of the socket member is configured to receive a twist pin contact. The plurality of socket members may be configured into an array that, includes rows and columns of socket members that project from the mating face in a common direction. Also, the mating face may be substantially planar. In addition, each conductor may include a mating tail that forms a compliant pin. The compliant pin may be configured to be inserted into a hole of the socket member such that the socket member and the compliant, pin, form an interference fit with each other and are mechanically and electrically coupled to each other. Also, the housing and the conductors of the electrical connector may be configured to transmit high-speed differential signals.

In another embodiment, an electrical connector assembly for interconnecting first and second electrical components is provided. The connector assembly includes a mating connector, that has a housing having a mating face and a plurality of a cavities extending into the housing. Each cavity has a mating contact therein that is electrically coupled to the first electrical component. The connector assembly also includes a socket connector that is configured to engage the mating connector. The socket connector includes a socket housing having, a mating face configured to engage the mating, face of the mating connector and a plurality of conductors that extend through the socket housing and are electrically coupled to the second electrical component. The socket connector also includes a plurality of socket members that, are electrically coupled to the conductors. Each socket member includes, a shaft that projects from the mating face of the socket housing and is configured for insertion into one of the cavities. The shaft forms a passage that is configured to receive the corresponding mating contact held within the cavity and to establish an electrical connection.

Optionally, the mating contacts are configured to establish multiple points of electrical contact within the shaft of the socket member.

DETAILED DESCRIPTION OF THE INVENTION

Figure 1:
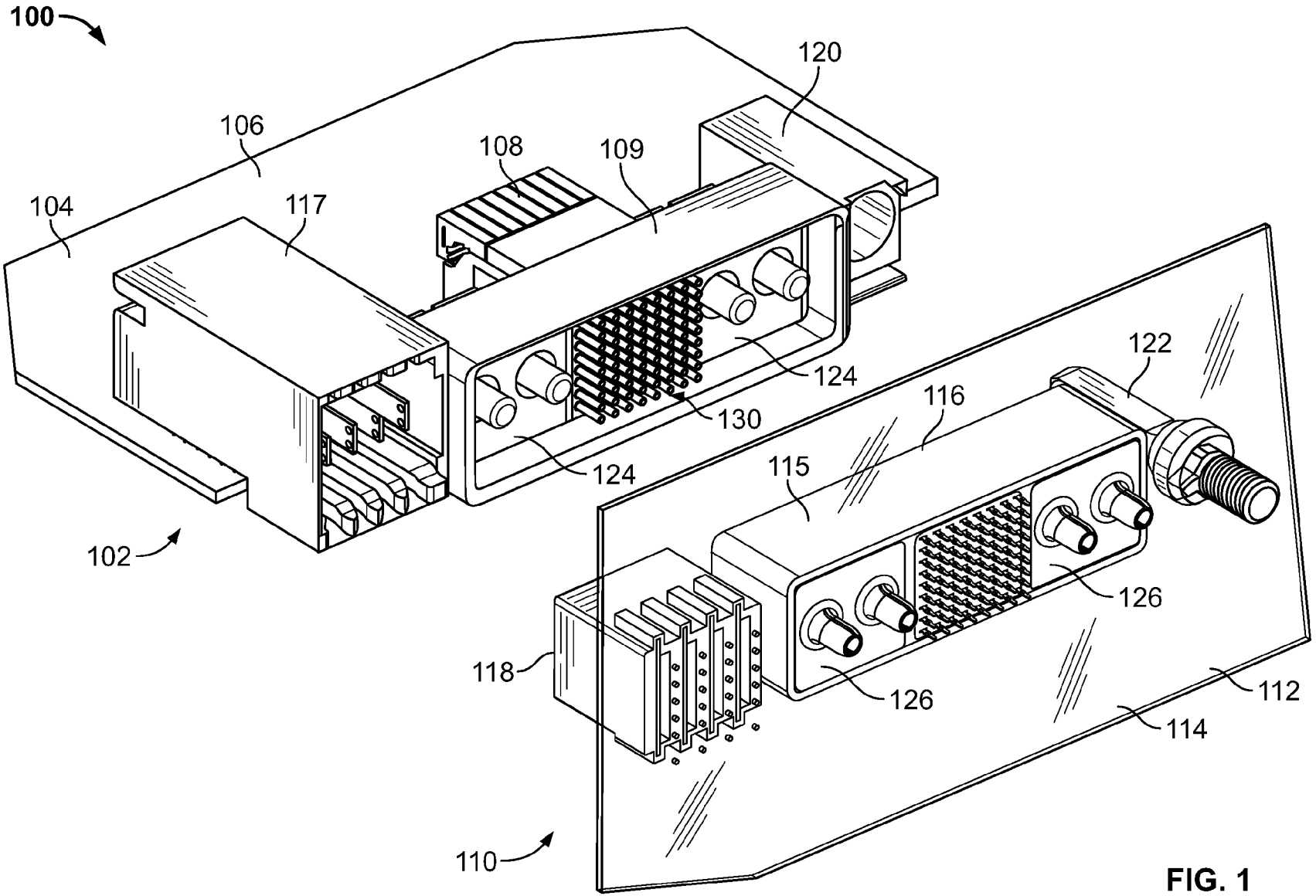
FIG. 1 is a perspective view of an electrical connector assembly formed in accordance with one embodiment.

FIG. 1 is a perspective view of an electrical connector assembly 100 formed in accordance with one embodiment. As shown, the connector assembly 100 includes a sub-assembly 102 that has an electrical component 104 (illustrated as a circuit board 106 in FIG. 1) and an electrical connector 108 mounted to the circuit board 106. The connector assembly 100 also includes another sub-assembly 110 having an electrical component 112, which is illustrated as a circuit board 114, and an electrical connector 116 mounted to the circuit board 114. The sub-assemblies 102 and 110 (and corresponding connectors 108 and 116) are configured, to mate with one another such that electrical signals and/or power may be transmitted therebetween. In the illustrated embodiment, the connectors 108 and 116 are configured to transmit differential signals. As will be discussed in greater detail below, the connector 108 includes a plurality of socket members 130 that are sized and shaped to be inserted into corresponding cavities 132 (FIG. 4) of the connector 116. The cavities 132 hold mating contacts 134 (FIG. 4), which, in one embodiment, may be twist pin contacts 236 (FIG. 5). When the connectors 108 and 116 are fully mated, the socket members 130, cavities 132, and twist pin contacts 236 facilitate maintaining a mechanical and electrical connection between the connectors 108 and 116. However, although the following description is with specific reference to the illustrated connectors 108 and 116, alternative embodiments of electrical connectors and assemblies may incorporate similar features and components as described herein. As such, the following description is provided for purposes of illustration, rather than limitation, and is but one potential application of the subject matter herein.

The connector 108 may be held and covered by a shield 109, and the connector 116 may be held and covered by a shield 115. Also, in addition to the connectors 108 and 116, the sub-assemblies 102 and 110 may have additional parts and connectors mounted to the circuit boards 106 and 114, respectively, such as another pair of mateable electrical connectors 117 and 118, complementary guiding features 120 and 122, and power connectors 124 and 126, which are illustrated as DIN power connectors but may be any other type of connector.

The connector assembly 100 (and corresponding sub-assemblies 102 and 110) may be configured for many applications, such as high-speed telecommunications equipment, various classes of servers, and data storage and transport devices. Also, the connector assembly 100 may be configured to transmit high-speed differential signals. As used herein, the term "high-speed" includes transmission speeds of approximately one (1) gigabit/s or greater. In one embodiment, connectors 108 and 116 are configured to transmit approximately 10 gigabit/s or greater. Furthermore, the connector assembly 100 may perform at high speeds and maintain signal integrity while withstanding vibrations and shock that may be experienced during, for example, aerospace or military operations. As such, the connector assembly 100 may be configured to satisfy known industry standards including military specifications, such as MIL-DTL-83513. However, embodiments described herein are not limited to applications for extreme environments, but may also be used in other environments, such as in an office or home.

Figure 2:
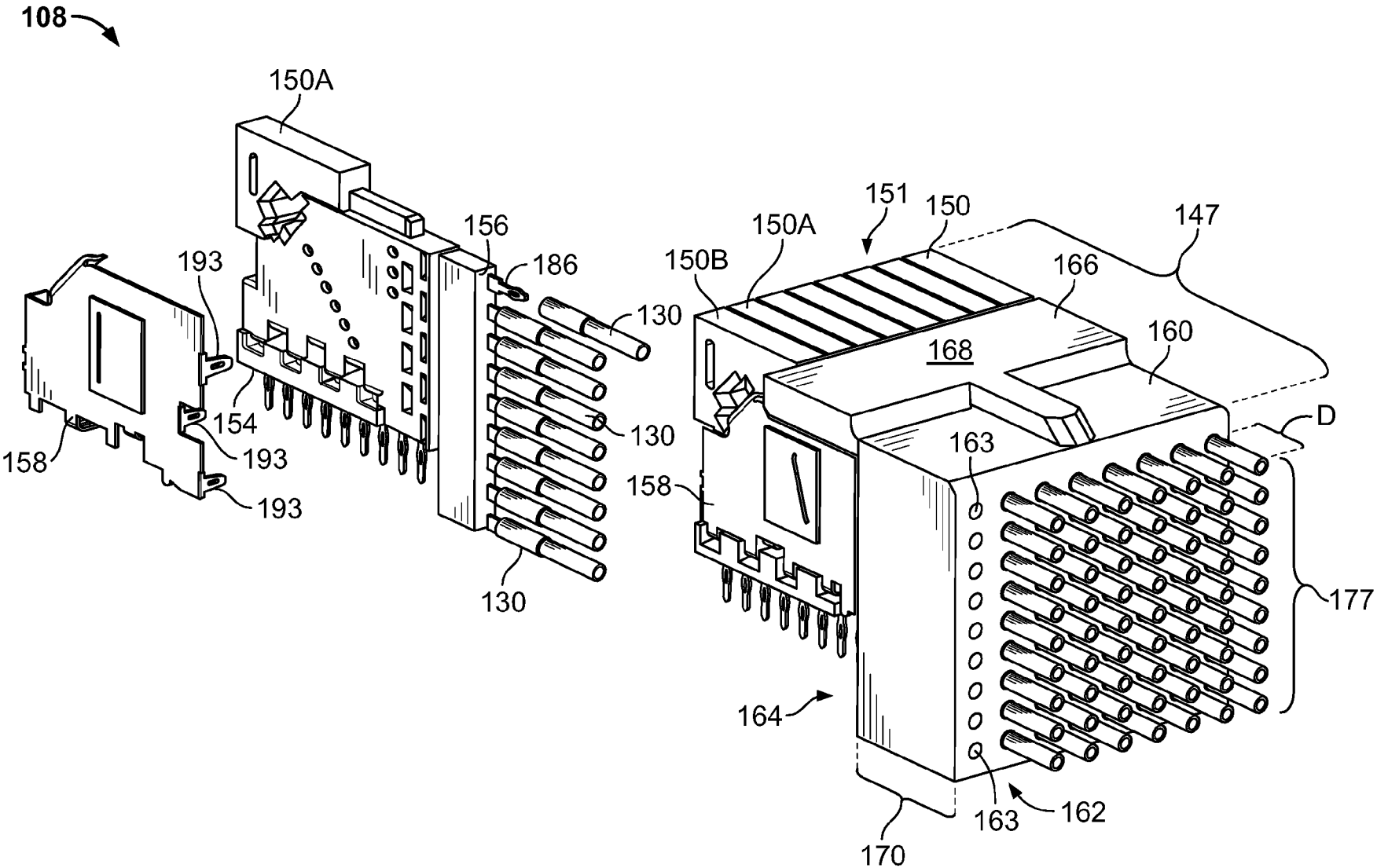
FIG. 2 is a partially exploded view of an electrical connector that may be used in the connector assembly shown in FIG. 1.
Figure 3:
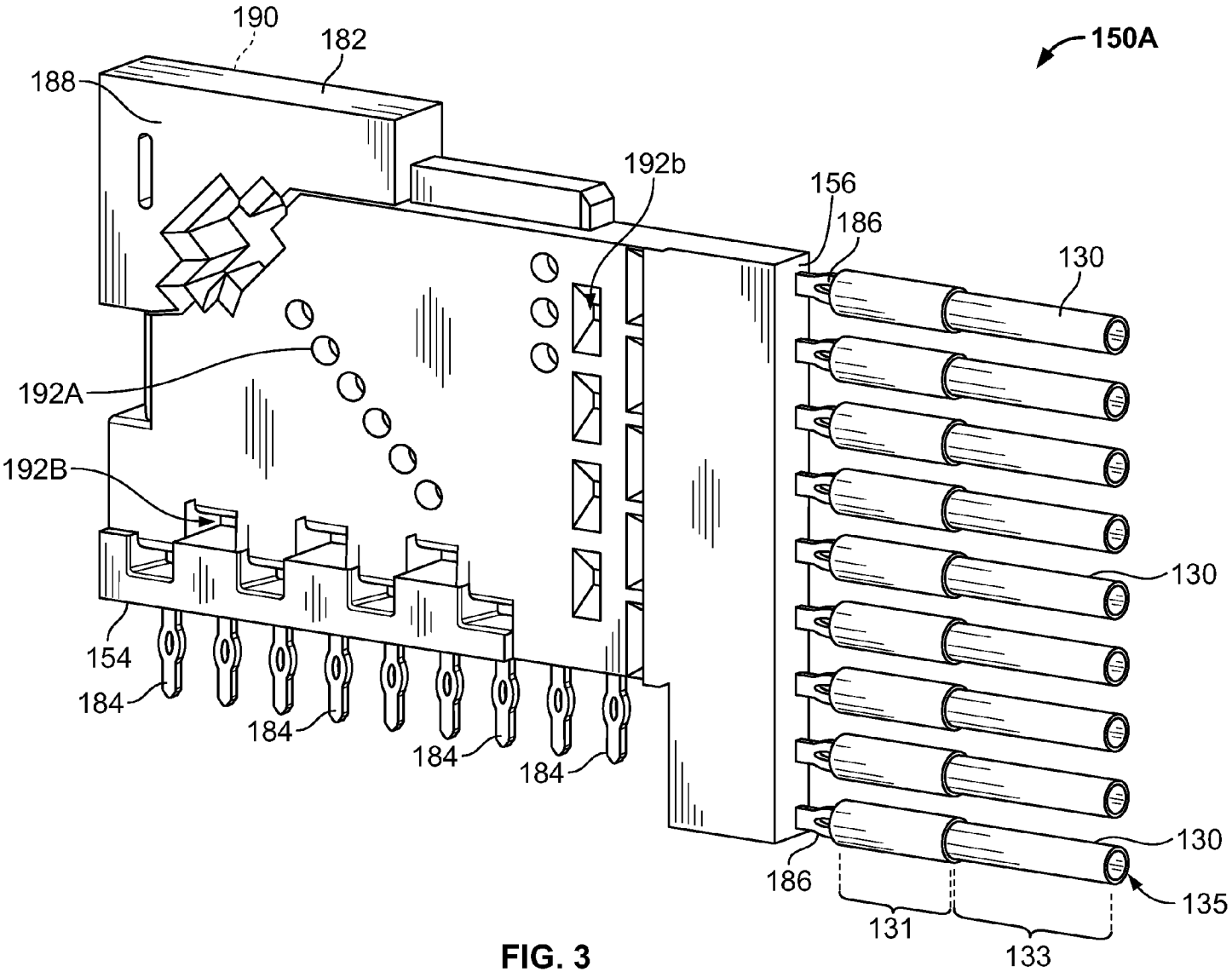
FIG. 3 is a perspective view of a contact module that may be used with the connector shown in FIG. 2.

FIG. 2 is a partially exploded view of the connector 108, and FIG. 3 is an isolated perspective-view of a contact module 150A that is used by the connector 108. As shown in FIG. 2, the connector 108 includes a housing assembly 147 that has a plurality of contact modules 150 and a front housing 160. The contact modules 150 may be grouped together or arranged to form a contact module assembly 151 (FIG. 2) that is, held by the front housing 160. The various features of the housing assembly 147 and the contact module(s) 150 may be designed to provide an electrical connector, such as the connector 108, that is operable at frequencies, densities, and/or throughputs that are relatively higher than electrical connectors without some or all of the features described herein, by reducing crosstalk, reducing noise persistence, reducing impedance footprint mismatch and/or reducing intra-pair skew.

Also shown in FIG. 2, each contact module 150 may include a plurality of conductors 152 (shown in FIG. 6) that extend between a mounting edge 154 and a mating edge 156 of the contact module 150. The contact modules 150 also include the socket members 130 that project from the mating edge 156 in a common direction (i.e., parallel with respect to each other). When fully assembled, the contact modules 150 may be held by the front housing 160 and arranged side-by-side. Each contact, module 150 may include one shield 158 on one side of the contact module 150. Alternatively, the contact module 150 may have shields on both sides. Also shown, the front housing 160 may include a substantially rectangular and planar mating face 162 and a rear side 164 that engages the contact modules 150. As shown, the front housing 160 may include a shroud 166 that covers a portion of the contact modules 150. An outer surface 168 of the shroud 166 may have features (e.g., ridges, grooves, or keys) for mating with the shield 109. The front housing 160 includes a dielectric front portion 170 that extends, between the rear side 164 and the mating face 162. A plurality of openings or passages 163 extend through the front portion 170 and are configured to receive the socket members 130 when the contact module assembly 151 (or individual contact modules 150) is inserted into the front housing 160. Although not shown, the front housing 160 may form open slots that receive and hold the mating edges 156 of each contact module 150.

The plurality of socket members 130 may project from the mating face 162 in a common direction and at a common distance D. The socket members 130 may form a forward-facing array 177, which may take a grid-like form of rows and columns of socket members 130. As will be discussed in greater detail below, in one embodiment, the array 177 of socket members 130 are received by a complementary array 204 (FIG. 4) of cavities 132. When the connectors 108 and 116 are fully mated, the socket members 130 and cavities 132 may cooperate with other features of the connectors 108 and 116 to facilitate mechanically and electrically coupling the connectors 108 and 116 together.

FIG. 3 illustrates the contact module 150 in greater detail. The contact module 150 includes an internal lead frame 180 (shown in FIG. 6) that includes the conductors 152 (FIG. 6) and is contained within a dielectric body 182. The lead frame 180 is enclosed within the body 182, but may be partially exposed by the body 182 in certain areas. In some embodiments, the body 182 is manufactured using an over-molding process. During the molding process, the lead frame 180 is encased in a dielectric material, which forms the body 182. A plurality of mating tails 186 extend from the mating edge 156 and a plurality of mounting tails 184 extend from the edge 154. In the illustrated embodiment, the mating edge 156 and the mounting edge 154 are generally perpendicular to one another (i.e., the connector 108 is a right-angle connector). Also shown, the body 182 includes opposite side portions 188 and 1910 that extend substantially parallel to and along the lead frame 180.

Figure 6:
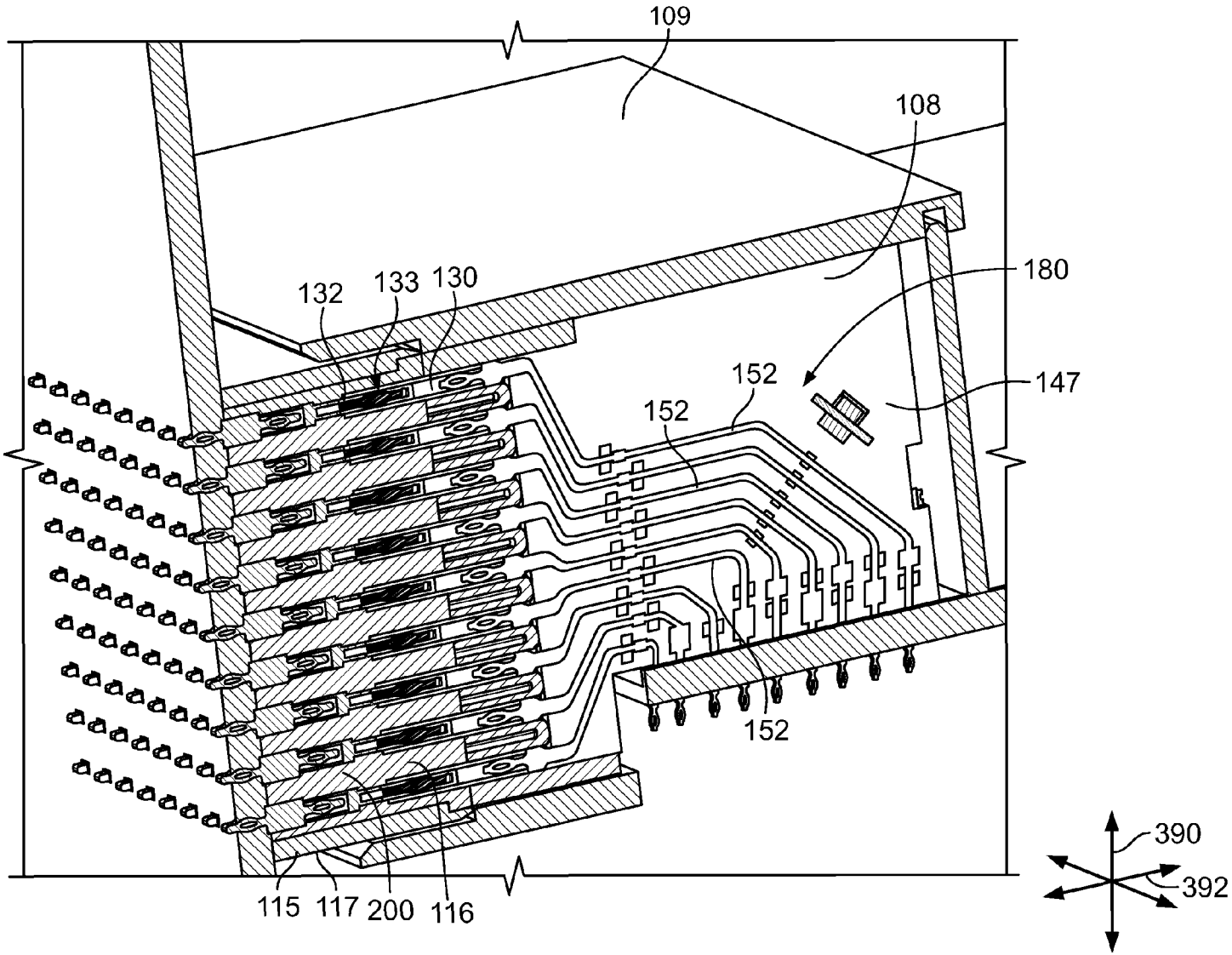
FIG. 6 is a perspective cross-sectional view of the connectors shown in FIGS. 2 and 4 when the connectors are in a fully mated position.

In the illustrated embodiment, the contact modules 150 include two different types of contact modules 150 (indicated as 150A and 150B in FIG. 2) that include different arrangements of conductors 152 (FIG. 6) or types of lead frames 180 (FIG. 6). When fully assembled, the contact modules 150A and 150B are plated alongside each other such that side portion 190 of the contact module 150A is adjacent to or abuts the side portion 188 of the contact module 150B.

Also, the body 182 may include a plurality of openings 192A and 192B formed entirely through the body 182 between the side portions 188 and 190. The openings 192A and 192B provide an air gap through the body 182 and may be provided between signal conductors of adjacent differential pairs. The openings 192A and 192B may have shapes and lengths that are selected to balance structural integrity of the contact module 150. The openings 192A and 192B may provide an air gap between signal conductors, which may decrease the cross-talk of the contact module 150 by providing an air dielectric therebetween as opposed to only a plastic dielectric. Selecting the width and the length of the openings 192A and 192B may balance these factors. Optionally, the openings 192 may be filled with a dielectric material having certain characteristics that may enhance at least one of the stability and the electrical performance of the contact modules 150 and/or module assembly 151.

In the illustrated embodiment the openings 192B are substantially rectangular and arranged near the mounting edge 154 and the mating edge 156 of the contact module 150. The openings 192B may be configured to receive grips 193 from the shield 158. The grips 192 may attach to and make electrical contact with a ground conductor.

In the illustrated embodiment, the mating tails 186 and 184 are compliant pins formed, to have an eye-of-needle shape. The compliant pins may be configured to form an interference, gas-tight, fit with a hole in a circuit board or with a hole 250 (shown in FIG. 7) of the socket member 130. As shown in FIG. 3, the socket members 130 may include a base portion 131 and a shaft 133. The base portion 131 includes the hole 250 through which the mating tail 186 is received and the shaft 133 includes a passage 135 in which the mating contact 134 (FIG. 4) is received. The diameter of base portion 131 is greater than a diameter of the shaft 133. When the connector 108 (FIG. 1) is fully assembled and the socket members 130 are inserted through the front housing 160, the base portion 131 of each socket member 130 may be prevented from moving away from the mating edge 156 because the openings 163 of the front housing 160 are configured to prevent movement by the socket member 130.

Figure 4:
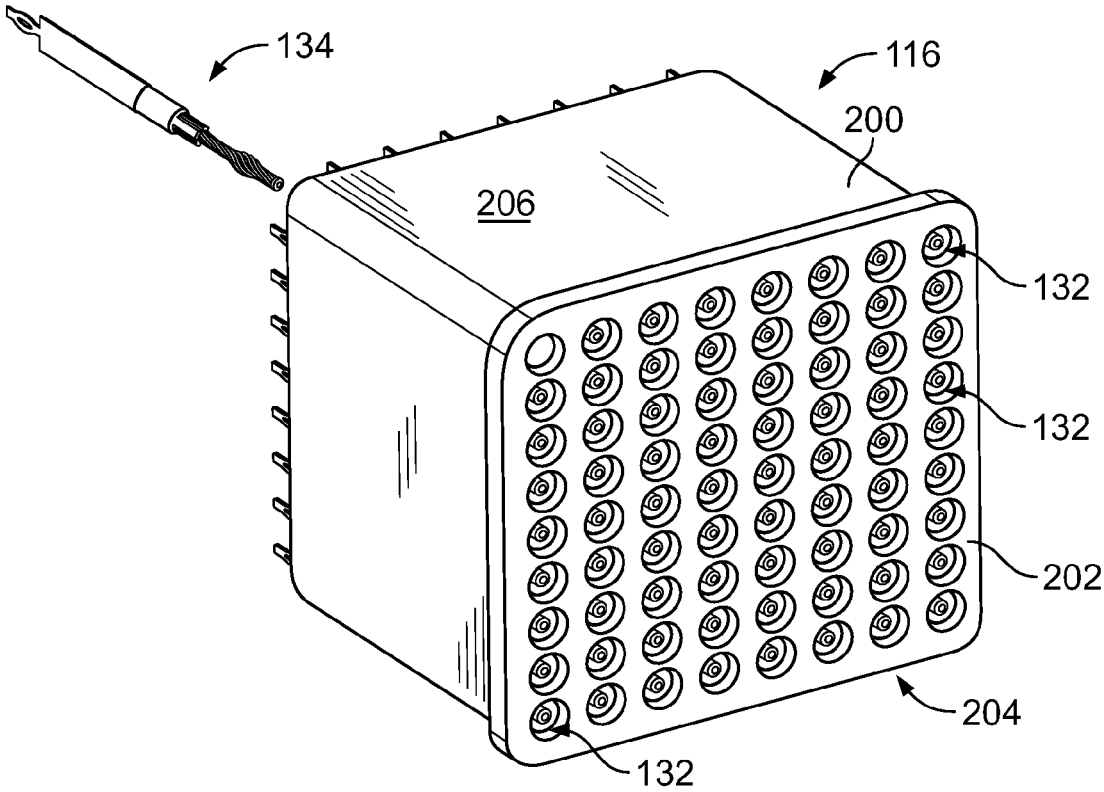
FIG. 4 is a partially exploded view of a mating connector that may mate with the electrical connector shown in FIG. 2.
Figure 5:
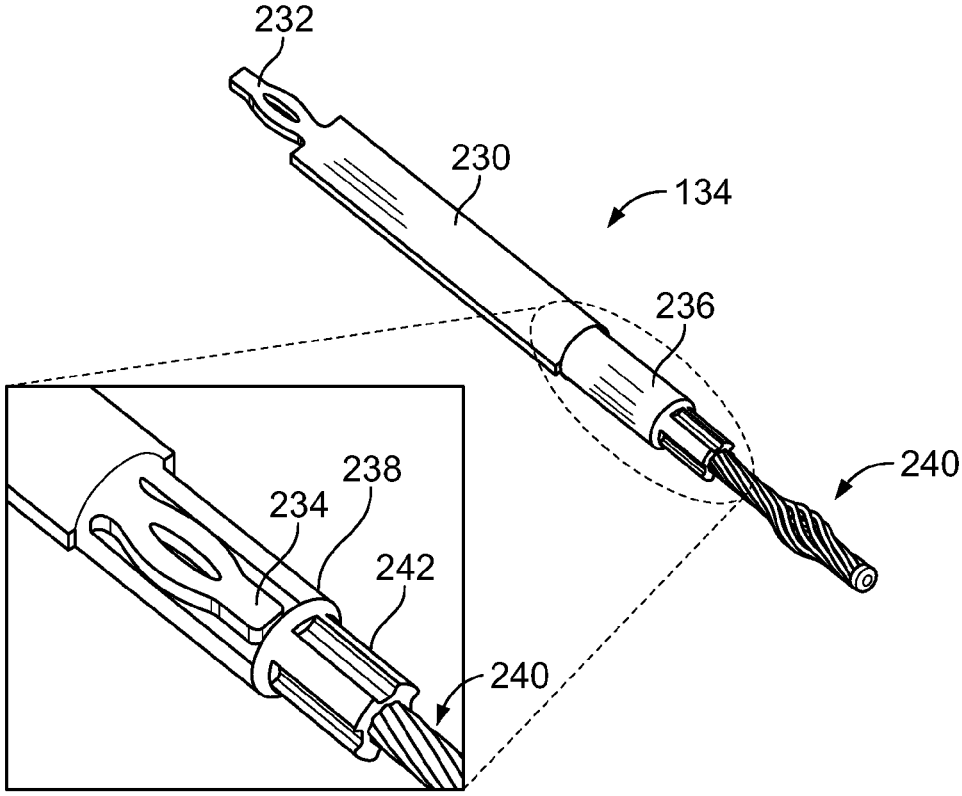
FIG. 5 is an isolated view of a mating contact that may be used with the mating connector shown in FIG. 4.

FIG. 4 is a partially exploded view of the connector 116 that includes a dielectric housing 200 that also has a mating face 202 configured to engage the mating face 162 (FIG. 2) of the connector 108 (FIG. 2). The connector 116 also includes a plurality of cavities 132 that, extend through the housing 200. In the illustrated embodiment, the cavities 132 extend linearly through the housing 200 and form a forward-facing array 204 of cavities 132, which may take a complementary grid-like form of rows and columns of cavities 132 with respect to the array 177 of socket members 130. The housing 200 may also have an outer surface 206 that surrounds the mating face 202. The outer surface 206 and housing 200 may be configured to be surrounded or held by a shield 115 (shown in FIG. 6).

The connector also includes a plurality of mating contacts 134 that are inserted into and held by the cavities 132. The mating contacts 134 are configured to, mate with the socket members 130 (FIG. 1) when the socket members 130 are inserted into the cavities 132. In one embodiment, the mating contact 134 is configured to form multiple points of electrical contact with the shaft 133 (FIG. 3) of the socket member 130 (FIG. 3). Each cavity 132 may have a rounded opening that initially directs the socket members 130 into the corresponding cavity 132. Also, the connector 116 may be a vertical-type connector as shown in FIG. 4 in that the paths of the mating contacts 134 are substantially linear. However, in alternative embodiments, the connector 116 may be another type of connector.

FIG. 5 is an isolated view of the mating contact 134 and includes a window showing an enlarged, exposed portion of the mating contact 134. In the illustrated embodiment, the mating contact 134 includes a conductive beam 230 having two ends 232 and 234 shaped into compliant pins. The beam 230 may have any length or shape in order to transmit signals or power through the connector 116 (FIG. 4). The compliant pin at the end 232 couples to, for example, the circuit board 114, and the compliant pin at the end 234 is coupled to a twist pin contact 236. The twist pin contact 236 includes a barrel 238 that is connected with a plurality of conductive wires 240 that are joined at a core 242. In one embodiment, the wires 240 are made from a copper material and are helically wound and terminate at a hemispherical weld. The wires 240 may form several self wiping spring surfaces that are configured for a consistent continuity and a very low noise level. As shown, the barrel 238 is configured to form a gas-tight, interference fit with a compliant pin formed by the end 234 of the beam 230. The barrel 238 and/or core 242 may also have guiding features on an outer surface thereof. When the mating contact 134 is, inserted into the cavity 132 (FIG. 4), the guiding features may direct the mating contact 134 into a predetermined position.

Figure 7:
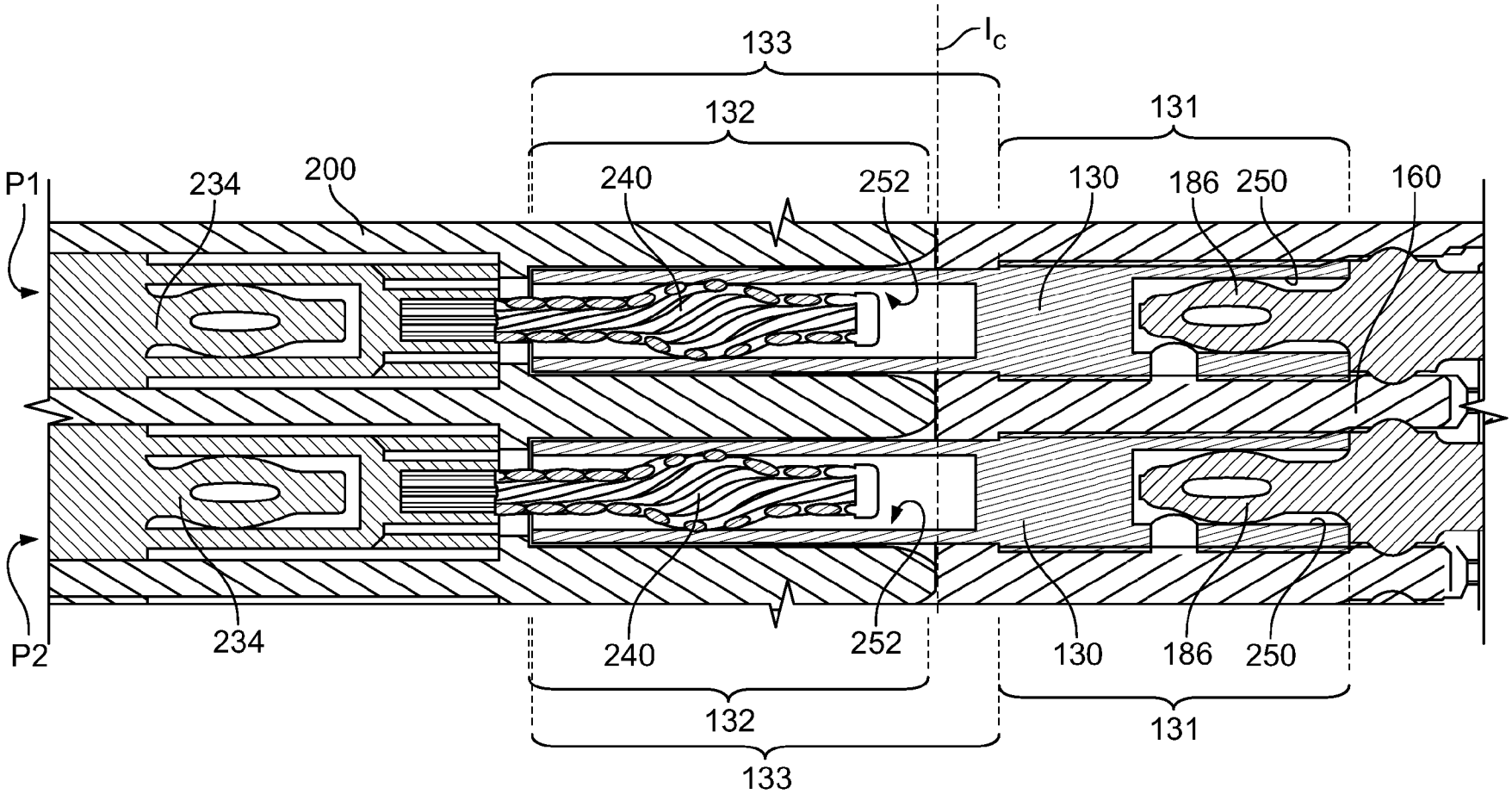
FIG. 7 is an enlarged cross-sectional view of the connectors shown in FIG. 6.

FIG. 6 is a perspective cross-sectional view of the connectors 108 and 116 in a fully mated position with each other, and FIG. 7 is a cross-sectional view of the engaged connectors 108 and 116 in FIG. 6. As discussed above, when the connectors 108 and 116 are engaged, the connectors 108 and 116 form a mechanical coupling that may withstand extreme temperature, shock, and/or vibrations while maintaining an effective-electrical connection. As shown, in the fully mated position, the housing assembly 147 and the housing 200 are adjacent to or directly abutting each other. The shafts 133 of the socket members 130 are inserted into the corresponding cavities 132 of the connector 116 the distance D (FIG. 2). In turn, the mating contact 134 of the connector 116 are inserted into and covered by the shaft 133 such that the twist pin contact 236 (FIG. 5) is electrically connected to the inner surface 252 (FIG. 7) of the shaft 133. As such, the wires 240 of the twist pin contact 236 form multiple points of electrical contact with the shaft 133 of the socket member 130.

FIG. 7 also illustrates electrical interconnecting portions P1 and P2 formed by the connectors 108 and 116. When; fully engaged, the mating faces 162 and 202 of the connectors 108 and 116, respectively, may directly abut each other along an interface $I_C$. As shown, the mating tail 186 is coupled to and forms an interference fit with the socket member 130, and the end 234 of the beam 230 (FIG. 5) is coupled to and forms an interference fit with the twist pin contact 236. The shaft 133 of the socket member 130 is inserted into a corresponding cavity 132 of the connector 116. In some embodiments, the shaft 133 may form an interference or compressive fit within the corresponding cavity 132. In the illustrated embodiment, as the socket member 130 is inserted into the corresponding cavity 132, the wires 240 are deflected into and slide along an inner surface 252 of the socket member 130. The wires 240 form multiple points of electrical contact with the inner surface 252.

The interconnecting portions P1 and P2 (and other interconnecting portions not shown) cooperate with each other such that the connectors 108 and 116 are mechanically and electrically coupled together. For example, the abutting mating faces 162 and 202, along with the shafts 133 within the cavities 132, prevent rotational movement about a vertical axis 390 (shown in FIG. 6). Also, the multiple shafts 133 within corresponding cavities 132 may prevent the connectors 108 and 116 from being inadvertently separated along a longitudinal axis 392 (shown in FIG. 6). In addition, the multiple points of contact formed by the wires 240 and the shafts 133 facilitate maintaining an electrical connection while the connectors 108 and 116 are sustaining shock and/or vibrations. As such, each interconnecting portion P1 and P2 forms an electrical and mechanical coupling.

As shown above, embodiments described herein may include electrical connectors that are ruggedized (i.e., built to sustain shock and vibrations and still maintain an effective electrical connection). However, embodiments herein are not limited to such applications. Also, although the illustrated embodiment shows a right-angle connector 108 coupling to a vertical connector 116, the connectors 108 and 116 may take many forms and, shapes and the connectors 108 and 116 may couple to each other in many orientations. For example, the connectors 108 and 116 may be incorporated into backplane electrical connector assemblies where the connectors 108 and 116 mate with each other in an orthogonal, coplanar, or mezzanine (stacking) manner.

In one alternative embodiment, the socket members 130 (FIG. 1) are not separately coupled to the conductors 152 (FIG. 6) but are formed with or are an integral part of the conductors 152.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective, terms "comprising" and "wherein." Moreover, in the following claims, the terms "first,", "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a mating face configured to engage a mating connector;

conductors extending through the housing, wherein the conductors form an array of conductors;

socket members projecting outwardly from the mating face, each of said socket members being electrically coupled to one of the conductors and comprising a shaft that projects beyond the mating face, the shaft configured to be inserted into a cavity of the mating connector, the shaft having an inner surface that defines a passage that is configured to receive an associated mating contact held within the cavity for establishing an electrical connection between the mating contact and the inner surface of the shaft; and contact modules having mating edges that interface with the housing and mounting edges that are configured to be mounted to an electrical component, each of said contact modules including a plurality of the conductors from the array of conductors, the conductors of each of said contact modules extending between mounting and mating tails, the mounting tails projecting from the mounting edge and the mating tails projecting from the mating edge and engaging corresponding socket members.

2. The electrical connector in accordance with claim 1 wherein the socket members are configured into an array that includes rows and columns of socket members projecting from the mating face in a common direction.

3. The electrical connector in accordance with claim 1 wherein the mating face is substantially planar, the socket members projecting from the mating face in a common direction.

4. The electrical connector in accordance with claim 1 wherein the inner surface of the shaft is configured to make multiple points of electrical contact with a twisted pin contact.

5. The electrical connector in accordance with claim 1 wherein the housing and the conductors are configured to transmit high-speed differential signals.

6. The electrical connector in accordance with claim 1 wherein the mating tails comprise compliant pins and the socket members have holes, each of said compliant pins projecting beyond the mating edge of the respective contact module into the hole of a corresponding one socket member to establish an electrical and mechanical connection.

7. The electrical connector in accordance with claim 1 wherein the housing has a side that interfaces with the mating edges of the contact modules, the housing holding the contact modules side-by-side with respect to each other.

8. The electrical connector in accordance with claim 1 wherein the plurality of conductors in each of said contact modules comprise a lead frame, each of said contact modules further comprising a dielectric body formed during an overmolding process that encases the conductors of the lead frame.

9. The electrical connector in accordance with claim 1 wherein each and every conductor of the contact modules is a conductor from the array of conductors.

10. The electrical connector in accordance with claim 1 wherein each of said socket members includes a base portion that is integrally formed with the shaft, the base portion having an interior surface that defines a hole that is configured to receive and engage the mating tail of one of the conductors, wherein electrical current is configured to flow through the shaft and the base portion between the interior surface of the base portion and the inner surface of the shaft.

11. The electrical connector in accordance with claim 1 wherein the housing comprises a dielectric material and a plurality of openings extending therethrough defined by the dielectric material, the openings being configured to receive corresponding socket members, the dielectric material of the front portion immediately surrounding each of said socket members such that the dielectric material contacts corresponding outer surfaces of the socket members or directly interfaces with the outer surfaces of the socket members.

12. An electrical connector assembly for interconnecting first and second electrical components, the connector assembly comprising:

a mating connector comprising a connector housing having a mating face and a plurality of cavities extending into the connector housing that are defined by a dielectric material of the connector housing, each of said cavities having a twist-pin mating contact therein that is configured to be electrically coupled to the first electrical component; and a socket connector configured to engage the mating connector, the socket connector comprising:

a socket housing having a mating face configured to engage the mating face of the mating connector;

a plurality of conductors extending through the socket housing, the conductors configured to be electrically coupled to the second electrical component; and a plurality of socket members electrically coupled to the conductors, each of said socket members comprising a shaft projecting outwardly from the mating face of the socket housing and configured for insertion into a corresponding one of the cavities, the shaft having an inner surface that defines a passage configured to receive the corresponding twist-pin mating contact held within the cavity and establish an electrical connection, wherein the shaft of each of said socket members and the corresponding one cavity of the connector housing are sized and shaped with respect to each other so that the shaft forms an interference fit with the dielectric material that defines the corresponding one cavity.

13. The connector assembly in accordance with claim 12 wherein the twist-pin mating contacts are configured to establish multiple points of electrical contact to the corresponding inner surfaces.

14. The connector assembly in accordance with claim 13 wherein the twist pin contacts are configured to maintain an electrical connection with the corresponding socket members while sustaining at least one of shock and vibrations.

15. The connector assembly in accordance with claim 12 wherein the plurality of socket members are configured into an array that includes rows and columns of socket members projecting from the mating face in a common direction.

16. The connector assembly in accordance with claim 12 wherein the mating face is substantially planar, the socket members projecting from the mating face in a common direction.

17. The connector assembly in accordance with claim 12 wherein the conductors include a mating tail having a compliant pin and the socket member includes a hole for receiving the compliant pin, the socket member and the compliant pin forming an interference fit with each other such that the socket member and the compliant pin are mechanically and electrically coupled to each other.

18. The connector assembly in accordance with claim 12 wherein the socket housing includes a front portion having the mating face thereon, the front portion having openings where the socket members extend through and project away from the housing.

19. The connector assembly in accordance with claim 12 wherein the mating face of the connector housing is substantially planar and the socket housing includes a substantially planar mating face, the mating faces of the connector housing and the socket housing directly abutting each other along an interface when the socket and mating connectors are engaged, the mating faces cooperating with each other to prevent rotational movement of at least one of the connector and socket housings with respect to each other while sustaining at least one of shock and vibrations.

* * * * *